US009498022B2

(12) United States Patent
Ikenaka et al.

(10) Patent No.: US 9,498,022 B2
(45) Date of Patent: Nov. 22, 2016

(54) SHOE UPPER AND METHOD FOR PRODUCING SHOE UPPER

(71) Applicant: Shima Seiki Mfg., Ltd., Wakayama-shi, Wakayama (JP)

(72) Inventors: Masamitsu Ikenaka, Wakayama (JP); Kenta Terai, Wakayama (JP)

(73) Assignee: SHIMA SEIKI MFG., LTD., Wakayama-Shi, Wakayama (JP)

( * ) Notice: Subject to any disclaimer, the term of this patent is extended or adjusted under 35 U.S.C. 154(b) by 0 days.

(21) Appl. No.: 14/898,583

(22) PCT Filed: Mar. 28, 2014

(86) PCT No.: PCT/JP2014/059173

§ 371 (c)(1),
(2) Date: Dec. 15, 2015

(87) PCT Pub. No.: WO2014/203584

PCT Pub. Date: Dec. 24, 2014

(65) Prior Publication Data

US 2016/0128428 A1 May 12, 2016

(30) Foreign Application Priority Data

Jun. 17, 2013 (JP) ..... 2013-126486

(51) Int. Cl.
*D04B 1/22* (2006.01)
*A43B 23/02* (2006.01)
(Continued)

(52) U.S. Cl.
CPC ..... *A43B 23/0245* (2013.01); *A43B 1/04* (2013.01); *A43B 23/0205* (2013.01);
(Continued)

(58) Field of Classification Search
CPC ..... D04B 1/22; D04B 1/123; D04B 15/56; D04B 1/14; D04B 19/42; A43B 23/0205; A43B 23/0245
See application file for complete search history.

(56) References Cited

U.S. PATENT DOCUMENTS 1,888,172 A * 11/1932 Joha ..... A43B 1/02 36/11
1,910,251 A * 5/1933 Joha ..... D04B 1/24 12/142 S (Continued)

FOREIGN PATENT DOCUMENTS

JP 2010-508994 A 3/2010
JP 2012-512698 A 6/2012

(Continued)

OTHER PUBLICATIONS

International Search Report issued in PCT/JP2014/059173 dated Jun. 24, 2014, 1 page.

*Primary Examiner* — Danny Worrell
(74) *Attorney, Agent, or Firm* — Rothwell, Figg, Ernst & Manbeck PC

(57) ABSTRACT

There is provided a shoe upper with high productivity in which a reinforcing section can be easily formed at the position of the heel or the toe, and a method for producing the same.

A shoe upper (1) in which an instep cover section (3) and a sole cover section (2) are integrally knitted in a seamless manner is provided. The shoe upper (1) includes a pocket section (4) formed extending over a left side portion and a right side portion of the shoe upper (1) at least at a position of a heel or a toe of the shoe upper (1). The pocket section (4) is configured by an outer side knitted fabric portion (40) configured with a part of the instep cover section (3), and an inner side knitted fabric portion (49) directly connected to the sole cover section (2) and entered to the inner side of the outer side knitted fabric portion (40). A pocket opening (**4*i*), which is an opening of the pocket section (4), opens at the side of the sole cover section (2**).

5 Claims, 6 Drawing Sheets

(51) Int. Cl.
*A43B 23/08* (2006.01)
*A43B 1/04* (2006.01)
*D04B 1/10* (2006.01)

(52) U.S. Cl.
CPC ..... *A43B 23/0235* (2013.01); *A43B 23/08* (2013.01); *A43B 23/088* (2013.01); *D04B 1/108* (2013.01); *D04B 1/22* (2013.01); *D10B 2403/0332* (2013.01); *D10B 2501/043* (2013.01); *D10B 2501/061* (2013.01)

(56) References Cited

U.S. PATENT DOCUMENTS 2,001,293 A * 5/1935 Wilson ..... D04B 1/24 36/10
2,330,199 A * 9/1943 Basch ..... D04B 1/106 2/80
2,376,399 A * 5/1945 Yandell ..... A43B 23/28 36/10
2,400,692 A * 5/1946 Herbert ..... A43B 1/04 36/10
2,440,393 A * 4/1948 Clark ..... A43B 1/02 12/142 G
4,785,558 A * 11/1988 Shiomura ..... A43B 1/04 36/114
6,931,762 B1 * 8/2005 Dua ..... A43B 1/04 12/142 G
7,347,011 B2 * 3/2008 Dua ..... A43B 1/04 36/10
7,774,956 B2 * 8/2010 Dua ..... A43B 1/04 36/45
8,448,474 B1 * 5/2013 Tatler ..... A43B 23/0245 66/177
9,084,449 B2 * 7/2015 Bell ..... A43B 1/04

FOREIGN PATENT DOCUMENTS

WO 2008/060928 A1 5/2008
WO 2010/080182 A1 7/2010

* cited by examiner (A)

(B)

SHOE UPPER AND METHOD FOR PRODUCING SHOE UPPER

CROSS REFERENCE TO RELATED APPLICATION

This application is a 35 U.S.C. 371 National Phase Entry Application from PCT/JP2014/059173, filed Mar. 28, 2014, which claims the benefit of Japanese Patent Application No. JP2013-126486 filed on Jun. 17, 2013, the disclosures of which are incorporated by reference in their entirety.

TECHNICAL FIELD

The present invention relates to a shoe upper having a pocket containing a reinforcement member formed at a position of a heel or toes, and a method for producing the shoe upper.

BACKGROUND ART

A shoe includes a shoe upper having a sole cover section that covers a sole of a wearer, and an instep cover section that covers a portion on an instep side of the wearer. In outdoor shoes, an outer sole made of synthetic resin and the like is attached to the sole cover section of the shoe upper. In recent years, attempts have been made to form the instep cover section, of the instep cover section and the sole cover section configuring the shoe upper, with one knitted fabric so that the shoe can be produced with high productivity. For example, in Patent Document 1, the instep cover section in a planarly developed state is produced with one knitted fabric, and then joined to the outer sole made of synthetic resin and the like along with the sole cover section, which is prepared separate from the instep cover section, to complete the shoe.

PRIOR ART DOCUMENT

Patent Document

[Patent document 1] Japanese Patent Application Publication No. 2010-508994

DISCLOSURE OF THE INVENTION

Problems to be Solved by the Invention

The shoe (shoe upper) of Patent Document 1, however, still can be improved in terms of productivity.

In Patent Document 1, the instep cover section is obtained by cutting one knitted fabric, or the instep cover section is obtained by fashioning. In the former case, a cutting step of the knitted fabric, and a sewing step for forming the instep cover section to a three-dimensional shape are required. In the latter case, the cutting step is not necessary but the sewing step is required.

The shoe may have a reinforcing section formed at the position of the heel or the toes, and in Patent Document 1 as well, a heel counter (reinforcing section) is arranged at the position of the heel. In Patent Document 1, the reinforcement member made of resin and the like is attached to the outer side of the shoe upper with an adhesive and the like to form the heel counter. However, the task of attaching the reinforcement member, which is hardly deform, to the shoe upper, which is a knit product and thus is likely to deform, is cumbersome, and such task lowers the productivity of the shoe. In addition, the technique of Patent Document 1 also has a problem in that the reinforcement member may come off during the use of the shoe.

The present invention has been made in light of the foregoing, and an object of the present invention is to provide a shoe upper with high productivity in which the reinforcing section can be easily formed at the position of the heel or the toes, and a method for producing the shoe upper. Another object of the present invention is to provide a shoe upper in which a drawback that the reinforcement member may come off during the use of the shoe upper does not arise, and a method for producing the shoe upper.

MEANS FOR SOLVING THE PROBLEMS

An aspect of the present invention relates to a shoe upper including an instep cover section that covers a portion on an instep side of a wearer and a sole cover section that covers a sole of the wearer. The instep cover section and the sole cover section of the shoe upper are integrally knitted in a seamless manner; and a pocket section formed extending over a left side portion and a right side portion of the shoe upper is arranged at least at a position of a heel or a toe of the shoe upper. The pocket section arranged in the shoe upper of the present invention is configured by an outer side knitted fabric portion configured with a part of the instep cover section, and an inner side knitted fabric portion directly connected to the sole cover section and entered to the inner side of the outer side knitted fabric portion. A pocket opening, which is an opening of the pocket section, opens at a side of the sole cover section.

According to one aspect of the shoe upper of the present invention, the outer side knitted fabric portion arranged in the shoe upper includes a projection that projects out toward the sole cover section from a boundary position of the instep cover section and the sole cover section.

An aspect of the present invention relates to a method for producing a shoe upper of producing a shoe upper including an instep cover section that covers a portion on an instep side of a wearer and a sole cover section that covers a sole of the wearer. In the method for producing the shoe upper of the present invention, when integrally knitting the instep cover section and the sole cover section in a seamless manner using a flat knitting machine including at least a pair of a front and a back needle bed, a pocket section that extends over a left side portion and a right side portion of the shoe upper and that has an opening at a side of the sole cover section is knitted at least at a position of a heel or a toe of the shoe upper. The pocket section is configured by an outer side knitted fabric portion configured with a part of the instep cover section, and an inner side knitted fabric portion directly connected to the sole cover section and entered to the inner side of the outer side knitted fabric portion; an inner left part, which is a left side portion of the inner side knitted fabric portion, and an outer left part, which is a left side portion of the outer side knitted fabric portion, are knitted while being attached to a needle bed on one side; and an inner right part, which is a right side portion of the inner side knitted fabric portion, and an outer right part, which is a right side portion of the outer side knitted fabric portion, are knitted while being attached to a needle bed on the other side. The inner left part is temporarily moved to the needle bed on the other side when knitting the outer left part; and the inner right part is temporarily moved to the needle bed on the one side when knitting the outer right part.

When referring to "an outer left part (outer right part) knitted while being attached to a needle bed on one side (needle bed on the other side)" means knitting the outer left part (outer right part) while holding the outer left part (outer right part) mainly on the needle bed on one side (needle bed on the other side). When knitting a pattern structure such as a rib structure in the outer left part (outer right part), a part of the outer left part (outer right part) may be knitted while being held on the needle bed on the other side (needle bed on one side).

According to one aspect of the method for producing the shoe upper of the present invention, when knitting the outer side knitted fabric portion, a projection that projects out toward the sole cover section from a boundary position of the instep cover section and the sole cover section is knitted in the outer side knitted fabric portion.

According to another aspect of the method for producing the shoe upper of the present invention, knitting is carried out from a shoe opening of the instep cover section toward a central part of the sole cover section or from the central part of the sole cover section toward the shoe opening of the instep cover section. In this case, when knitting the inner side knitted fabric portion, the inner left part and the inner right part are connected on a side including the pocket section in a knitting width direction; and when knitting the outer side knitted fabric portion, the outer left part and the outer right part are connected on a side including the pocket section in a knitting width direction. Specifically, when knitting the pocket section at the position of the heel, the inner left part (outer left part) and the inner right part (outer right part) are connected on the heel side in the knitting width direction. When knitting the pocket section at the position of the toe, the inner left part (outer left part) and the inner right part (outer right part) are connected on the toe side in the knitting width direction. Of course, when knitting the outer side knitted fabric portion, the inner side knitted fabric portion is moved so as not to be interwoven into the outer side knitted fabric portion.

EFFECTS OF THE INVENTION

The shoe upper of the present invention including a pocket section at least at the position of the heel or the toe can easily form the reinforcing section at the position of the pocket section, and excels in productivity. High productivity of the shoe upper is realized firstly because the instep cover section and the sole cover section configuring the shoe upper are integrally knitted, and secondly because the pocket section is integrally knitted with the shoe upper, and thus the reinforcing section can be formed in the shoe upper by simply inserting the reinforcement member into the pocket section and closing the pocket opening of the pocket section. Moreover, with the configuration of inserting the reinforcement member into the pocket section, the positioning of the reinforcement member with respect to the shoe upper is facilitated, and the problem of the reinforcement member coming off from the shoe upper during the use of the shoe upper does not arise.

The projection is formed on the outer side knitted fabric portion configuring the pocket section, that is, the outer side knitted fabric portion is formed long, so that the pocket opening can be closed with the projection when the reinforcement member is contained inside the pocket section. As a result, the reinforcement member can be effectively suppressed from falling out from inside the pocket section. Furthermore, when attaching the outer sole to the sole cover section of the shoe upper, the outer sole can be easily attached by bending the projection so as to close the pocket opening of the pocket section, whereby satisfactory finishing of the boundary portion of the shoe upper and the outer sole can be achieved.

According to the method for producing the shoe upper, the shoe upper including the pocket section at least at the position of the heel or the toe can be produced. In particular, when knitting from the shoe opening of the instep cover section toward the central part of the sole cover section or knitting from the central part of the sole cover section toward the shoe opening of the instep cover section, the shoe upper can be produced without carrying out complex transfer and the like.

MODE FOR CARRYING OUT THE INVENTION

Hereinafter, embodiments of a shoe upper and a method for producing the same of the present invention will be described based on the drawings. A two-bed flat knitting machine including at least a pair of a front and a back needle bed and in which stitches can be transferred between the front and back needle beds is used to produce the shoe upper. Of course, the flat knitting machine to be used is not limited to the two-bed flat knitting machine, and for example, may be a four-bed flat knitting machine.

<First Embodiment>

<<Overall configuration>>

Figure 1:
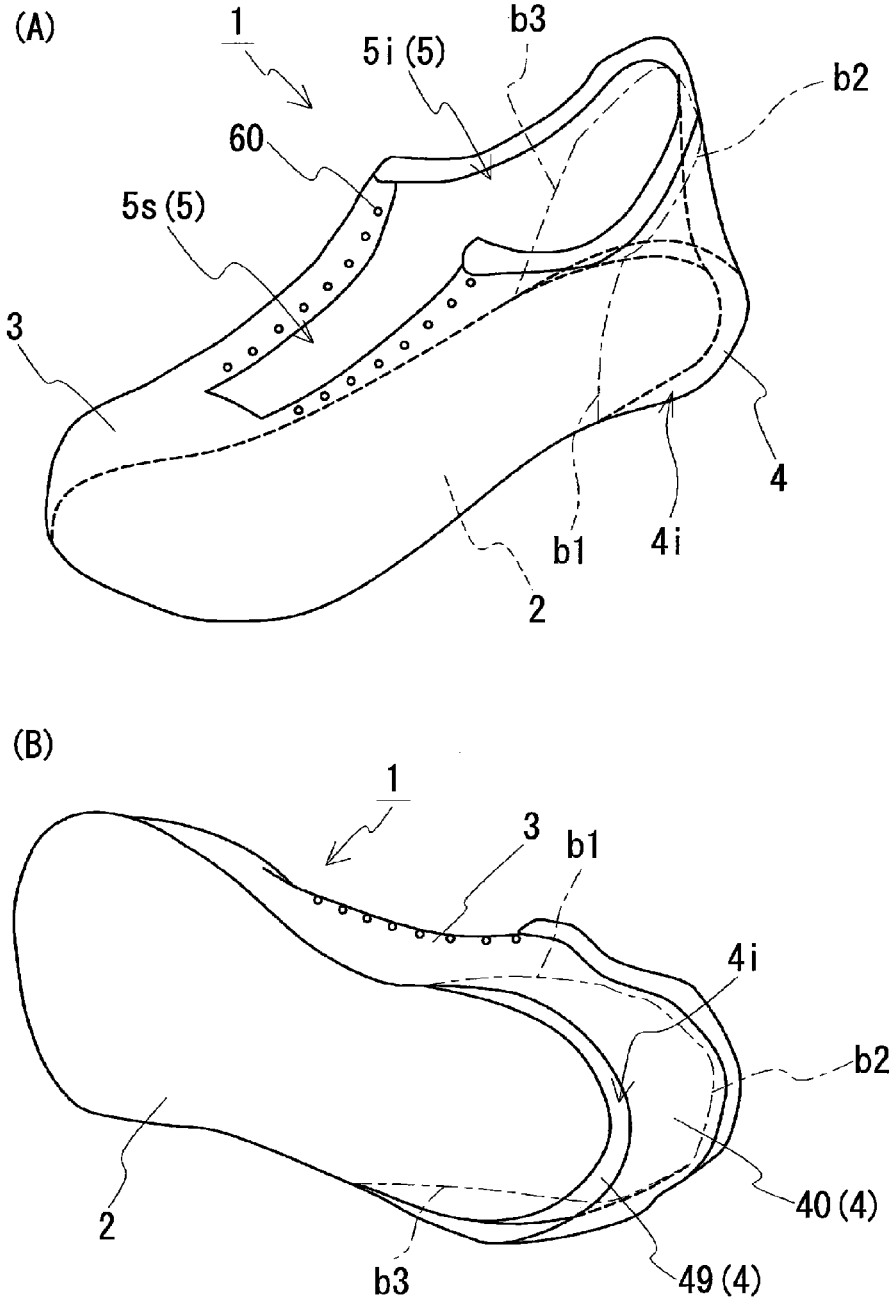
FIG. 1(A) is a schematic top perspective view of a shoe upper shown in a first embodiment.
FIG. 1(B) is a schematic bottom perspective view of the shoe upper.

A shoe upper 1 shown in FIG. 1 includes an instep cover section that covers a portion on an instep side of the foot of a wearer, and a sole cover section 2 that covers a portion of a sole of the wearer. The shoe upper 1 may be used as it is as a shoe, or the outer side of the sole cover section 2 configuring the shoe upper 1 may be attached with an outer sole (not shown) made of resin and the like to be used as a shoe.

The shoe upper 1 shown in FIG. 1 differs from the conventional shoe upper in the following two points.

[1] The instep cover section 3 and the sole cover section 2 are three-dimensionally knitted in a seamless manner without seam.

[2] A pocket section 4 that contains a reinforcement member for reinforcing the shoe upper 1 is provided at the position of the heel of the shoe upper 1.

The instep cover section 3 and the sole cover section 2 are preferably knitted with a fusible knitting yarn containing a heat fusible yarn. With the use of the fusible knitting yarn, the shoe upper 1 can be three-dimensionally shaped when the shoe upper 1 is fitted to a last (foot model) and subjected to thermal processing. The instep cover section 3 and the sole cover section 2 may, of course, be knitted with a non-fusible knitting yarn that does not contain the heat fusible yarn, or the instep cover section 3 and a part of the sole cover section 2 may be knitted with the fusible knitting yarn and the remaining portion may be knitted with the non-fusible knitting yarn. For example, the portions of the toe, the heel, the portion slightly on the heel side of the base of the toe and the like may be knitted with the fusible knitting yarn, and the remaining portion may be knitted with the non-fusible knitting yarn.

<<Instep Cover Section>>

A shoe opening 5 is formed on the upper side of the instep cover section 3. The shoe opening 5 includes a foot insertion opening 5*i*, into which the wearer inserts the foot, and a slit 5*s* extending from the foot insertion opening 5*i* toward the toe side. An eyelet hole 60, which is a hole for passing a shoelace, is formed at the position of the slit 5*s* in the instep cover section 3. The eyelet hole is not necessary for shoe that does not have a shoelace.

<<Sole Cover Section>>

When using the shoe upper 1 as it is as the shoe, the sole cover section 2 is a section that becomes the shoe sole. When attaching the outer sole to the outer side of the sole cover section 2, the sole cover section 2 functions as an insole of the shoe. In either case, the sole cover section 2 covers the entire sole of the wearer.

<<Pocket section>>

The pocket section 4 is configured by an outer side knitted fabric portion 40 configured with a part on the heel side of the instep cover section 3, and an inner side knitted fabric portion 49 formed directly to the sole cover section 2 and entered into the outer side knitted fabric portion 40. The outer side knitted fabric portion 40 and the inner side knitted fabric portion 49 are connected at a position (position of joining lines b1, b3 shown with a chain dashed line) in the vicinity of the ankle of the left side portion and the right side portion of the instep cover section 3, and a position (position of joining line b2 shown with a chain dashed line) in the vicinity of the foot insertion opening 5*i* that extends over the left side portion and the right side portion, and hence a pocket opening 4*i*, which is an opening of the pocket section 4, opens at the sole cover section 2 side.

The joining lines b1, b3 in the present embodiment are inclined toward the heel side gradually from the sole cover section 2 to the shoe opening 5, but may be inclined toward the toe side, or may be straightly extended in the height direction of the shoe upper 1, that is, may not be inclined toward the heel side nor the toe side.

The pocket section 4 is a bag that interiorly contains a reinforcement member. The reinforcement member functions as a heel counter that reinforces the heel of the shoe upper 1 to prevent the shoe upper 1 from losing shape, and also enhances the fitting property of the shoe (shoe upper 1) with respect to the wearer. Such reinforcement member includes, for example, a curved plate material made of resin that lies along the shape of the heel of the wearer.

According to the configuration of inserting the reinforcement member into the pocket section 4, the alignment of the reinforcement member with respect to the shoe upper 1 is completed at the time point the reinforcement member is inserted into the pocket section 4. Thus, the formation of the reinforcing section (i.e., heel counter) using the reinforcement member is facilitated, and the productivity of the shoe upper 1 (shoe) is enhanced. Furthermore, after inserting the reinforcement member into the pocket section 4, the pocket opening 4*i* of the pocket section 4 can be closed so that the problem of the reinforcement member falling out from the shoe upper 1 during the use of the shoe upper 1 does not arise. Furthermore, according to the configuration of inserting the reinforcement member into the pocket section 4, the reinforcement member can be attached to the shoe upper 1 even if the reinforcement member is made from a material difficult to be adhered to the shoe upper 1 with an adhesive.

The pocket section 4 may be formed at the position of the toe of the shoe upper 1. If the pocket section 4 is formed at the toe, the toe of the shoe upper 1 can be reinforced, whereby the toe of the wearer can be protected. Of course, the pocket section 4 may be formed at both the position of the heel and the position of the toe.

<<Method for Producing Shoe Upper>>

The shoe upper 1 can be produced roughly by the following four knitting methods. With any knitting method, the shoe upper 1 is produced by being knitted with the right side portion of the shoe upper 1 attached to one needle bed (front needle bed or back needle bed) and the left side portion attached to the other needle bed (back needle bed or front needle bed) of the flat knitting machine.

[Knitting method I] Knitting method of starting the knitting from the position of the shoe opening 5 of the instep cover section 3 and terminating the knitting at the position of the central part of the sole cover section 2.

[Knitting method II] Knitting method of starting the knitting from the position of the central part of the sole cover section 2 and terminating the knitting at the position of the shoe opening 5 of the instep cover section 3.

[Knitting method III] Knitting method of starting the knitting from the position of the toe of the shoe upper 1 and terminating the knitting at the position of the heel.

[Knitting method IV] Knitting method of starting the knitting from the position of the heel of the shoe upper 1 and terminating the knitting at the position of the toe.

Among the four knitting methods, the knitting method I and the knitting method II are knitting methods in which the knitting proceeds in the height direction of the shoe upper 1, and the knitting method III and the knitting method IV are knitting methods in which the knitting proceeds in the length direction of the shoe upper 1. Each knitting method will be sequentially described below.

<<Knitting method I: Instep Cover section→sole cover section>>

Figure 2:
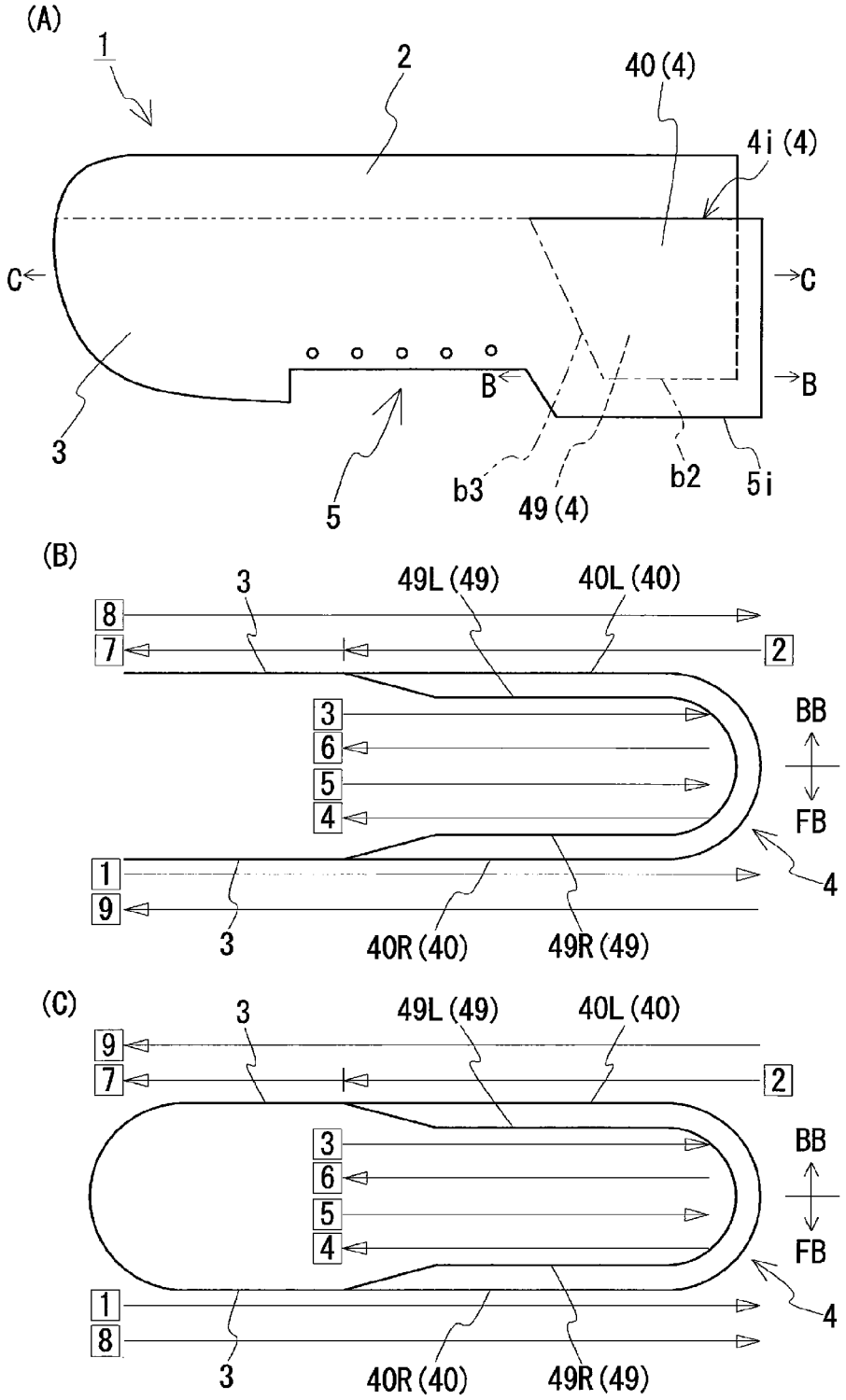
FIG. 2(A) is a schematic view showing an overall knitting procedure of a knitting method I.
FIG. 2(B) is a schematic view showing one example of a knitting procedure of when knitting a line B-B of FIG. 2(A)
FIG. 2(C) is a schematic view showing one example of a knitting procedure of when knitting a line C-C of FIG. 2(A).

FIG. 2(A) is a schematic view showing a knitting procedure of a right side portion of the shoe upper 1. In the knitting method I, the knitting is carried out from the lower side toward the upper side in the plane of drawing of the schematic view shown in FIG. 2(A). The left side portion of the shoe upper 1 may be considered as being arranged on the far side in the plane of drawing of FIG. 2(A). The right side portion and the left side portion of the shoe upper 1 are connected at the position of the heel arranged on the right side in the plane of drawing, and the position of the toe arranged on the left side in the plane of drawing. Needless to say, the shape of the foot is asymmetric, and thus the knitting width and the like of the right side portion and the left side portion of the shoe upper 1 are preferably changed according to the shape of the foot.

(Outline of Knitting)

In the knitting method I shown in FIG. 2(A), a portion to become the shoe opening 5 of the shoe upper 1 is first knitted. The right side portion (hereinafter referred to as a main body right portion) of the instep cover section 3 is knitted with one needle bed, and the left side portion (hereinafter referred to as a main body left portion) of the instep cover section 3 is knitted with the other needle bed.

In the knitting, the flechage knitting, the C-shaped knitting, and the tubular knitting are used selectively according to the three-dimensional shape of the shoe upper 1, and the instep cover section 3 in which the main body right portion and the main body left portion are connected at the position of the toe and the position of the heel is knitted. When knitting the instep cover section 3, the pocket section 4 extending over the main body right portion and the main body left portion is knitted at the position of the heel of the shoe upper 1.

The specific knitting procedure of the instep cover section 3 including the pocket section 4 will be described using the schematic views shown in FIGS. 2(B) and 2(C). FIG. 2(B) is a schematic view showing one example of the knitting procedure at line B-B of FIG. 2(A), and FIG. 2(C) is a schematic view showing one example of the knitting procedure at line C-C of FIG. 2(A). In FIGS. 2(B) and 2(C), the respective attached states of the instep cover section 3 and the pocket section 4 seen from the upper side of the front needle bed (FB) and the back needle bed (BB), and the order of knitting of each section are shown, where the direction of knitting is shown with an arrow, and the order of knitting is shown with a number surrounded by a square.

At the vicinity of the foot insertion opening 5*i* of the shoe upper 1 (vicinity of the line B-B of FIG. 2(A)), the main body right portion of the instep cover section 3 is knitted toward the heel side (see first knitting=number one surrounded with square), as shown in FIG. 2(B). A portion on the heel side of the instep cover section 3 also serves as an outer side knitted fabric portion 40 of the pocket section 4, and therefore, the right side portion (outer right part 40R) of the outer side knitted fabric portion 40 is knitted by such first knitting. Next, of the left side portion of the instep cover section 3, the left side portion (outer left part 40L) of the outer side knitted fabric portion 40 is knitted toward the toe side (second knitting). In such first knitting and second knitting, the inner side knitted fabric portion 49 is moved so as not to be interwoven into the outer side knitted fabric portion 40. This will be specifically described later with reference to a knitting process view of FIG. 3. According to the first and second knitting, the outer right part 40R and the outer left part 40L are knitted while being connected on the heel side in the knitting width direction.

Then, the inner side knitted fabric portion 49 of the pocket section 4 is knitted by the C-shaped knitting having the heel side as the turn-back end. Specifically, the knitting is carried out in the order of left side portion (inner left part 49L) of the inner side knitted fabric portion 49→right side portion (inner right part 49R) of the inner side knitted fabric portion 49→inner right part 49R→inner left part 49L (third to sixth knitting). The inner right part 49R and the inner left part 49L are knitted while being connected on the heel side in the knitting width direction by the C-shaped knitting.

Next, the remaining of the main body left portion knitted up to the middle in the second knitting is knitted toward the toe side (seventh knitting). The main body left portion is knitted toward the heel side (eighth knitting), and the main body right portion is knitted toward the toe side (ninth knitting). In the eighth knitting and the ninth knitting, the inner side knitted fabric portion 49 is moved so as not to be interwoven into the outer side knitted fabric portion 40. According to the eighth and ninth knitting, the outer right part 40R and the outer left part 40L are knitted while being connected on the heel side in the knitting width direction.

In the main body portion from the heel to the toe of the shoe upper 1 (see line C-C of FIG. 2(A)), the knitting is preferably carried out as shown in FIG. 2(C). The first to seventh knitting of FIG. 2(C) are exactly the same as FIG. 2(B). In the knitting procedure of FIG. 2(C), the main body right portion is knitted toward the heel side in the eighth knitting, and the main body left portion is knitted toward the toe side in the ninth knitting. That is, in such knitting, the instep cover section 3 is tubular knitted from the seventh to ninth knitting. The outer right part 40R and the outer left part 40L are knitted while being connected on the heel side in the knitting width direction by the eighth and ninth knitting as well.

The knitting procedure shown in FIGS. 2(B) and 2(C) is the knitting procedure in which the number of stitches in the wale direction of each section is the same number. Of course, the number of stitches in the wale direction of each section may be intentionally differed.

(Knitting of Pocket Section)

The forming state of the stitches of when knitting the pocket section 4 will be described based on the knitting process view of FIG. 3. In the knitting process view of FIG. 3, the knitting of the portion corresponding to the pocket section 4 in FIG. 2(B) is shown, where a chain dashed line on the left side in the plane of drawing is the boundary position of the pocket section 4 (position corresponding to the joining line b3 of FIG. 2(A)). Alphabet+number in the left column of FIG. 3 indicates the number of the knitting process, and the middle column indicates the held state of the stitches in each knitting step. Alphabets A to M under the middle column indicate the positions of the knitting needles. Furthermore, the arrow in the right and left direction of the right column indicates the knitting direction, and the arrow in the up and down direction indicates the transfer. The drop (oval-shaped) mark in the middle column indicates the stitch of the inner side knitted fabric portion 49, the circle mark indicates the stitch other than that of the inner side knitted fabric portion 49, and the V-shaped mark indicates a pickup stitch. The black mark indicates a stitch knitted in each knitting step.

Figure 3:
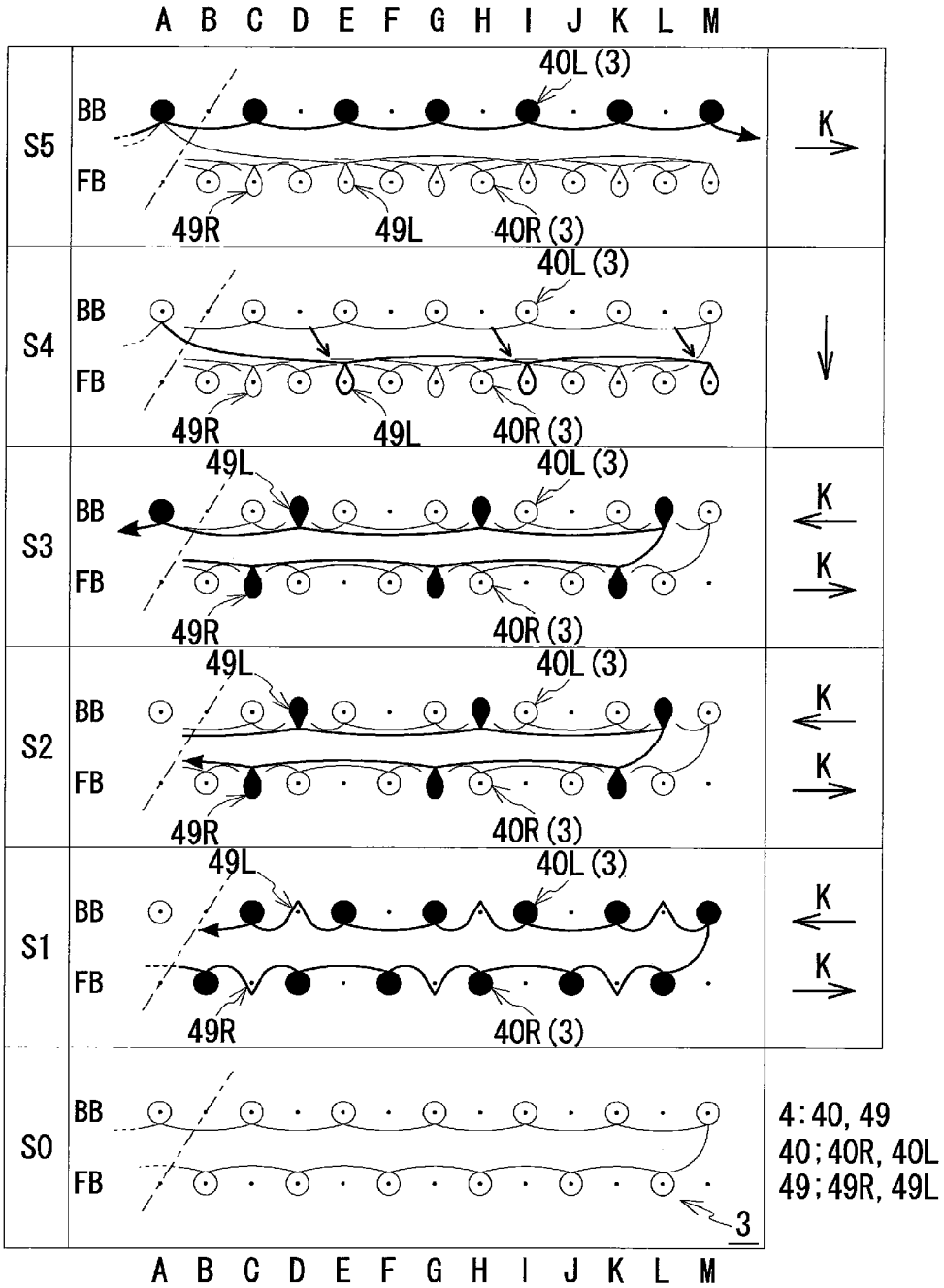
FIG. 3 is a knitting process view of a pocket section shown in the knitting method I.

S0 of FIG. 3 shows a state in which the stitches of the main body right portion of the instep cover section 3 are held on the knitting needles B, D, F, H, J, L of the FB, and the stitches of the main body left portion are held on the knitting needles A, C, E, G, I, K, M of the BB. That is, the instep cover section 3 is knitted by a half gauge knitting. The main body right portion and the main body left portion are connected at the position on the heel side of the shoe upper 1 (see FIG. 2) arranged on the right side in the plane of drawing, such connection thus forming the heel. The knitting of the pocket section 4 is started from such state.

In S1, the main body left portion and the main body right portion of the instep cover section 3 following the wale direction of the stitches shown in S0 are knitted, and the set up portion of the inner side knitted fabric portion 49 of the pocket section 4 is knitted by the C-shaped knitting. The stitches formed on the knitting needles B, D, F, H, J, L of the FB are the main body right portion of the instep cover section 3 and are the outer right part 40R of the outer side knitted fabric portion 40 configuring the pocket section 4, and the stitches formed on the knitting needles C, E, G, I, K, M of the BB are the main body left portion of the instep cover section 3 and are the outer left part 40L of the outer side knitted fabric portion 40. The pickup stitches formed on the knitting needles C, G, K of the FB are the set up portion of the inner right part 49R of the inner side knitted fabric portion 49, and the pickup stitches formed on the knitting needles D, H, L of the BB are the set up portion of the inner left part 49L of the inner side knitted fabric portion 49. The pickup stitches correspond to the joining line b2 of FIGS. 1 and 2.

According to S1 described above, the outer right part 40R and the outer left part 40L connected on the heel side in the knitting width direction are knitted, and the inner side knitted fabric portion 49 is branched from the outer side knitted fabric portion 40. The knitting of the outer right part 40R and the outer left part 40L in S1 corresponds to the first to second knitting in the knitting procedure of FIG. 2(B). Since the inner side knitted fabric portion 49 is not yet knitted at the time point of S0, the operation of moving the inner side knitted fabric portion 49 when knitting the outer side knitted fabric portion 40 is not necessary.

In S2, after knitting the inner left part 49L with the knitting needles D, H, L of the BB by the C-shaped knitting, the inner right part 49R is knitted with the knitting needles K, G, C of the FB. S2 corresponds to the third to fourth knitting of FIG. 2(B). In S2, tuck or knit may be carried out on the stitch of the outer right part 40R of the knitting needle B of the FB, or the stitch of the main body right portion held on the knitting needle on the left side of the knitting needle A of the FB so that the inner right part 49R is connected to the instep cover section 3. If the outer side knitted fabric portion 40 and the inner side knitted fabric portion 49 are knitted with different knitting yarns, the stitches of both portions 40, 49 may be overlapped and the inner side knitted fabric portion 49 may be connected to the instep cover section 3.

In S3, after knitting the inner right part 49R with the knitting needles C, G, K of the FB, the inner left part 49L is knitted with the knitting needles L, H, D of the BB and the main body left portion of the instep cover section 3 is knitted (a part of the stitches of the main body left portion is shown on the knitting needle A of the BB). S3 corresponds to the fourth to seventh knitting of FIG. 2(B).

In S4, the stitches of the inner left part 49L held on the knitting needles D, H, L of the BB are moved to the knitting needles E, I, M of the FB. This is an operation to prepare for the knitting of the outer left part 40L in the next S5. In S5, the outer left part 40L is knitted with the knitting needles C, E, G, I, K, M of the BB (the stitch of the knitting needle A of the BB is the stitch of the instep cover section 3). In this case, since the stitches of the inner left part 49L are moved to the FB in S4, the inner left part 49L can be avoided from being interwoven into the outer left part 40L. S4 and S5 correspond to the eighth knitting of FIG. 2(B).

In and after S5, the outer right part 40R is knitted through an idea similar to S4 and S5 (corresponding to the ninth knitting of FIG. 2(B)). Specifically, the stitches of the inner right part 49R and the inner left part 49L held on the FB in S5 are moved to empty needles of the BB, and the outer right part 40R is knitted with the knitting needles L, J, H, F, D, B of the FB. In this case, since the inner right part 49R and the inner left part 49L are not held on the FB, the inner right part 49R and the inner left part 49L will not be interwoven into the outer right part 40R. The outer left part 40L and the outer right part 40R are knitted in the knitting of the outer right part 40R and the knitting of the outer left part 40L of S5 described above, and a state in which the parts 40L, 40R are connected on the heel side in the knitting width direction is obtained.

The knitting similar to the knitting described above is repeated, and after the pocket section 4 of a desired size as shown in FIG. 2(A) is knitted, the end in the wale direction of the outer side knitted fabric portion 40 is performed with the bind-off process to complete the pocket section 4. The terminating end in the wale direction of the inner right part 49R of the inner side knitted fabric portion 49 is held on the FB, and the terminating end in the wale direction of the inner left part 49L is held on the BB. A bottom right part to become the right side portion of the sole cover section 2 is formed by performing the flechage knitting with the FB, and a bottom left part to become the left side portion of the sole cover section is formed by performing the flechage knitting with the BB. As a result, the sole cover section 2 is knitted directly in the wale direction of the inner side knitted fabric portion 49, and a state in which the sole cover section 2 and the inner side knitted fabric portion 49 are connected is obtained.

Lastly, the bottom right part and the bottom left part are connected at a central line extending in the length direction of the sole cover section 2 to complete the shoe upper 1. The method of connecting the bottom right part and the bottom left part is not particularly limited, and for example, a known bind-off process can be used. Alternatively, the bottom right part and the bottom left part may be connected with the front and back knits in which the stitches are alternately knitted on the front and back needle beds. With the front and back knits that do not require the transfer, the bottom right part and the bottom left part can be connected in a very short time, compared to the bind-off process that requires transfer. Since the connecting portion (i.e., knitting end portion of the shoe upper 1) is fused by thermal process after the knitting of the shoe upper 1, the connection strength of the connecting portion is ensured regardless of what connecting method is used to form the connecting portion. Furthermore, since the connecting portion is located at a position that cannot be seen when the shoe upper 1 is worn, the appearance of the shoe upper 1 is not degraded by the connecting portion.

In the present knitting method I, a state in which the number of stitches of the inner side knitted fabric portion 49 is less than the number of stitches of the outer side knitted fabric portion 40, that is, a state in which the loop quality of the inner side knitted fabric portion 49 is rougher than the loop quality of the outer side knitted fabric portion 40 is obtained. However, since the inner side knitted fabric portion 49 is located at a position that cannot be seen from the outer side of the shoe upper 1, the appearance of the shoe upper is not degraded by the difference in loop quality. However, the loop quality of the knitted fabric portions 40, 49 may be formed the same by using the four-bed flat knitting machine.

(Effect)

According to the knitting method I described above, the pocket section 4 in which the pocket opening 4*i* opens at the sole cover section 2 side shown in FIG. 1 can be formed at the heel of the shoe upper 1. Of course, when forming the pocket section 4 at the toe of the shoe upper 1, the pocket section 4 in which the pocket opening 4*i* opens at the lower side can be formed through a procedure similar to the procedure of the knitting method I.

Furthermore, in the knitting method I, the shoe upper 1 can be knitted by barely carrying out or without carrying out at all, the formation of widening stitches and narrowing stitches, complex transfer and the like by advancing the knitting in the height direction of the shoe upper 1. Thus, the shoe upper 1 can be produced with high productivity.

<<Knitting Method II: Sole Cover Section 2→instep cover section 3>>

In the knitting method II, an example of starting the knitting from the position of the central part of the sole cover section 2, and terminating the knitting at the position of the shoe opening 5 of the instep cover section will be described. FIG. 2(A) used in the description of the knitting method I will be referred to for the description.

In the knitting method II, the knitting is carried out from the upper side to the lower side in the plane of drawing of FIG. 2(A). Specifically, the set up portion is first knitted on the front and back needle beds. The set up portion corresponds to the position of the central part of the sole cover section 2. The bottom left part and the bottom right part of the sole cover section 2 are knitted respectively with different needle beds based on such set up portion.

After the sole cover section 2 is completed, the set up portion is knitted on the empty needles on which the sole cover section 2 is not held within a partial region on the heel side of the sole cover section 2. The set up portion is a starting end of the outer side knitted fabric portion 40 (a part on the heel side of the instep cover section 3) of the pocket section 4, and forms the pocket opening 4*i*. Thereafter, similar to the knitting method I described with reference to FIGS. 2(C) and 2(B), the inner side knitted fabric portion 49 in which the right and the left are connected on the heel side is knitted, and the outer side knitted fabric portion 40 in which the right and the left are connected on the heel side is knitted. Of course, when knitting the outer side knitted fabric portion 40 with the FB (BB), the stitches of the inner side knitted fabric portion 49 are moved to the BB (FB) so that the inner side knitted fabric portion 49 is not interwoven in the outer side knitted fabric portion 40. Furthermore, the outer side knitted fabric portion 40 and the inner side knitted fabric portion 49 are connected at the positions of the joining lines b2, b3.

After the knitting of the pocket section 4 is terminated, the flechage knitting, the tubular knitting, and the C-shaped knitting are used selectively to complete the shoe upper 1. In the knitting method II described above, the shoe opening 5 becomes the knitting end of the shoe upper 1.

<<Knitting Method III: Toe→Heel>>

In the knitting method III, an example of starting the knitting from the position of the toe of the shoe upper 1 shown in FIG. 1 and terminating the knitting at the position of the heel will be described based on a schematic view of the knitting procedure of FIG. 4 and the knitting process view of the pocket section of FIG. 5. The way of viewing FIGS. 4 and 5 is similar to FIGS. 2(A) and 3, respectively.

Figure 4:
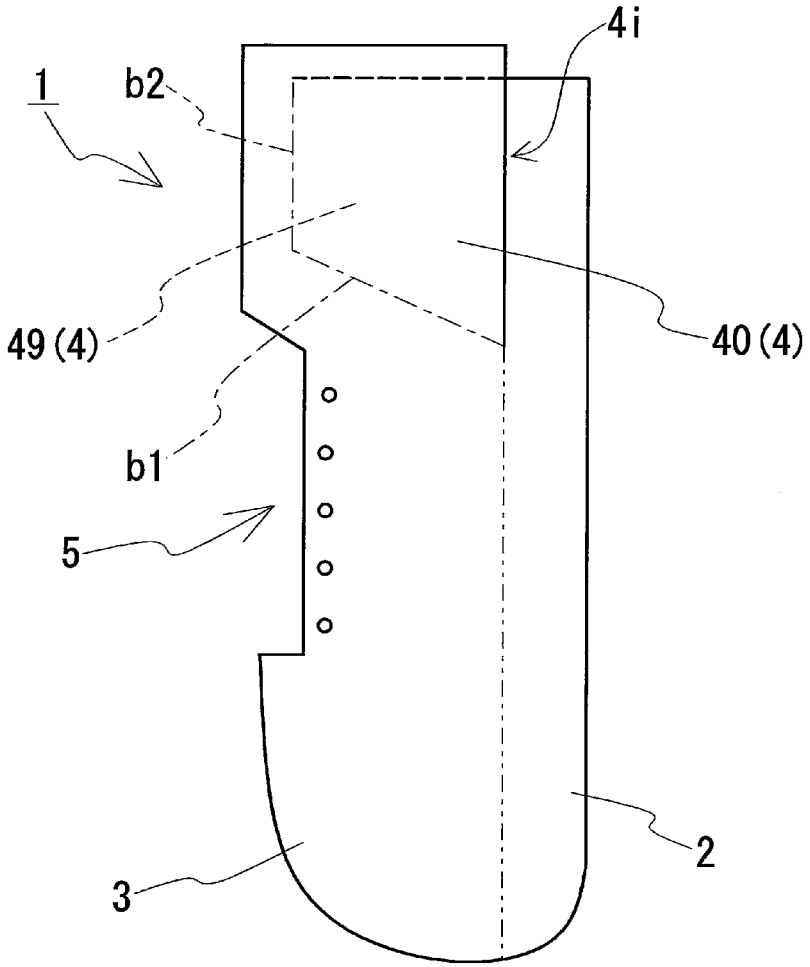
FIG. 4 is a schematic view showing a knitting procedure of a knitting method III.
Figure 5:
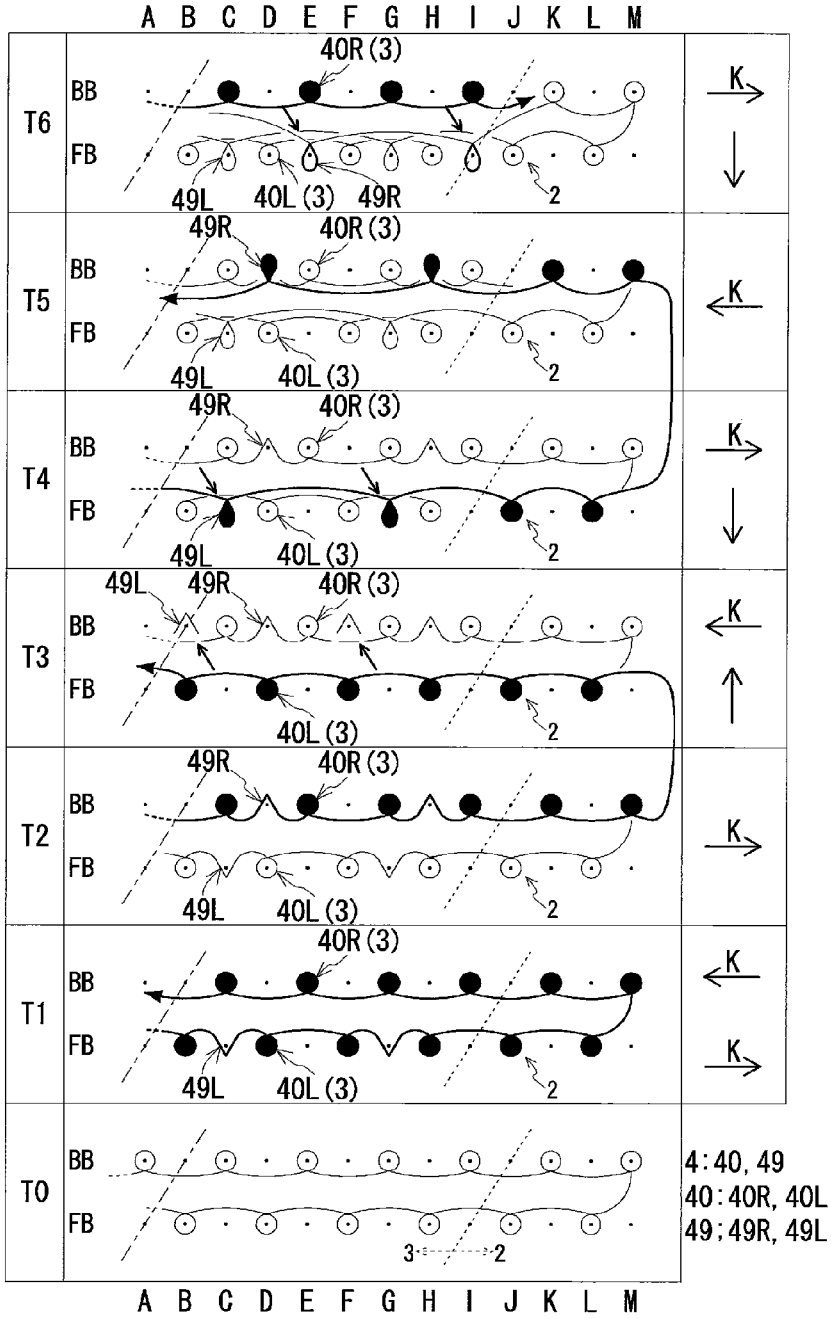
FIG. 5 is a knitting process view of a pocket section shown in the knitting method III.

FIG. 4 is a schematic view showing a knitting procedure of the left side portion of the shoe upper 1 when starting the knitting from the toe, and the knitting is carried out from the lower side toward the upper side in the plane of drawing. The right side portion of the shoe upper 1 may be assumed as being arranged on the far side in the plane of drawing of FIG. 4, where the bottom left part and the bottom right part of the sole cover section 2 are connected at the position on the right side in the plane of drawing, and the instep portion of the main body left portion and the instep portion of the main body right portion of the instep cover section are connected at the position on the left side in the plane of drawing.

(Outline of Knitting)

In the knitting method III shown in FIG. 4, the portion from the toe up to immediately before the formation of the pocket section 4 is first knitted while selectively using the flechage knitting, the tubular knitting, and the C-shaped knitting using the front and back needle beds. Then, the instep cover section 3 and the sole cover section 2 are knitted while knitting the pocket section 4 extending over the main body left portion and the main body right portion to complete the shoe upper 1. The knitting procedure of the pocket section 4 will be described later with reference to the knitting process view of FIG. 5.

According to the knitting method III, the seam of the left side portion and the right side portion of the shoe upper 1 is arranged at the position of the heel of the shoe upper 1, and since the seam is not provided at the central part of the sole cover section 2, the shoe upper 1 (shoe) excelling in wearing feeling can be produced.

(Knitting of Pocket Section)

Next, a specific knitting procedure of the pocket section 4 will be described based on the knitting process view of FIG. 5. T0 of FIG. 5 shows a state in which the instep cover section 3 and the sole cover section 2 knitted up to the position immediately before the pocket section 4 are held on the front and back needle beds. A dotted line indicates the boundary of the cover sections 3 and 2, and the seam is not provided on the boundary. Specifically, the stitches of the main body left portion are held on the knitting needles B, D, F, H of the FB, the stitches of the bottom left part are held on the knitting needles J, L of the FB, the stitches of the main body left portion are held on the knitting needles C, E, G, I of the BB, and the stitches of the bottom right part are held on the knitting needles K, M of the BB. The knitting of the pocket section 4 is started from such state. The chain dashed line in FIG. 5 indicates the boundary of the portion including the pocket section 4 and the portion not including the pocket section 4, where the knitting of the portion not including the pocket section 4 is omitted in FIG. 5.

In T1, the instep cover section 3 and the sole cover section 2 following the wale direction of the stitches shown in T0 are knitted by the C-shaped knitting with the central part of the sole cover section 2 arranged at one end side (right side in plane of drawing) in the knitting width direction as a turn-back end. Along with the knitting of both sections 2 and 3, the pickup stitches to become the set up portion (a part on the toe side of the joining line b1 in FIG. 4) of the inner left part 49L of the inner side knitted fabric portion 49 of the pocket section 4 is knitted with the knitting needles C, G of the FB. The instep cover section 3 also serves as the outer side knitted fabric portion 40 of the pocket section 4.

In T2, the outer right part 40R is knitted, and the pickup stitches to become the set up portion of the inner right part 49R of the inner side knitted fabric portion 49 are knitted with the knitting needles D, H of the BB.

In T3, the stitches of the inner left part 49L held on the knitting needles C, G of the FB are respectively moved to the knitting needles B, F of the BB, and the outer left part 40L is knitted with the knitting needles L, J, H, F, D, B of the FB. The inner left part 49L can be avoided from being interwoven into the outer left part 40L by moving the inner left part 49L to the BB in T3.

In T4, the stitches of the inner left part 49L moved to the BB in T3 are returned to the original knitting needles (knitting needles C, G of the FB), and then the inner left part 49L and the bottom left part (see knitting needles J, L of the FB) of the sole cover section 2 are knitted. In T5, the bottom right part (see knitting needles M, K of the BB) of the sole cover section 2 and the inner right part 49R are knitted. According to T4 and T5, the sole cover section 2 and the inner side knitted fabric portion 49 directly connected to the sole cover section 2 are knitted. On the left side of the chain dashed line, the inner side knitted fabric portion 49 and the outer side knitted fabric portion 40 are connected.

In T6, the stitches of the inner left part 49R held on the knitting needles D, H of the BB are respectively moved to the knitting needles E, I of the FB, and then the outer right part 40R is knitted with the knitting needles C, E, G, I of the BB. The inner left part 49R can be avoided from being interwoven into the outer right part 40R by moving the inner right part 49R to the FB.

As described above, the outer side knitted fabric portion 40 and the inner side knitted fabric portion 49 are knitted while temporarily moving the inner side knitted fabric portion 49 when knitting the outer side knitted fabric portion 40, so that the outer side knitted fabric portion 40 and the inner side knitted fabric portion 49 can be knitted concurrently.

<<Knitting method IV: heel→toe>>

In the knitting method IV, an example of starting the knitting from the position of the heel of the shoe upper 1 shown in FIG. 1, and terminating the knitting at the position of the toe will be described. Upon making the description, FIGS. 4 and 5 used in the description of the knitting method III are used.

In the knitting method IV, the knitting is carried out from the upper side toward the lower side in the plane of drawing of FIG. 4. Specifically, the set up portion corresponding to the position of the heel of the instep cover section 3 is first knitted with the front and back needle beds. The left side portion and the right side portion of the instep cover section 3 are knitted for a few courses respectively with different needle beds based on such set up portion.

Next, an independent set up portion different from the knitted instep cover section 3 is knitted. The set up portion becomes a starting point of knitting the inner side knitted fabric portion 49 of the pocket section 4 and the sole cover section 2. Thereafter, the pocket section 4 is knitted in a manner shown in FIG. 5. In this case, the inner side knitted fabric portion 49 and the outer side knitted fabric portion 40 are connected using knit, tuck, double stitches and the like at the joining lines b2, b1 of FIG. 4.

After the knitting of the pocket section 4 is terminated, the flechage knitting, the tubular knitting, and the C-shaped knitting are used selectively to carry out the knitting up to the toe of the shoe upper 1, and then the left side portion and the right side portion of the shoe upper 1 are connected to complete the shoe upper 1.

According to the knitting method IV described above, the right and left seams are not provided in the sole cover section 2 in which the right and left seams of the shoe upper 1 are arranged at the position of the toe of the shoe upper 1, and hence the shoe upper 1 (shoe) excelling in wearing feeling can be produced.

<<Finishing of Shoe Upper>>

After the knitting of the shoe upper 1 by one of the knitting methods described above is terminated, the entire shoe upper 1 is fitted to the last and the reinforcement member is inserted into the pocket section 4. The outer sole is then attached to the sole cover section 2 so that the pocket opening 4*i* of the pocket section 4 is hidden, and the entire shoe upper 1 is subjected to thermal processing to three-dimensionally mold the shoe upper 1. The connecting portion of the bottom left part and the bottom right part of the sole cover section 2 are fused, and the pocket opening 4*i* is closed by the thermal process. As a result, the shoe having the heel counter at the position of the heel can be produced.

<Second Embodiment>

Figure 6:
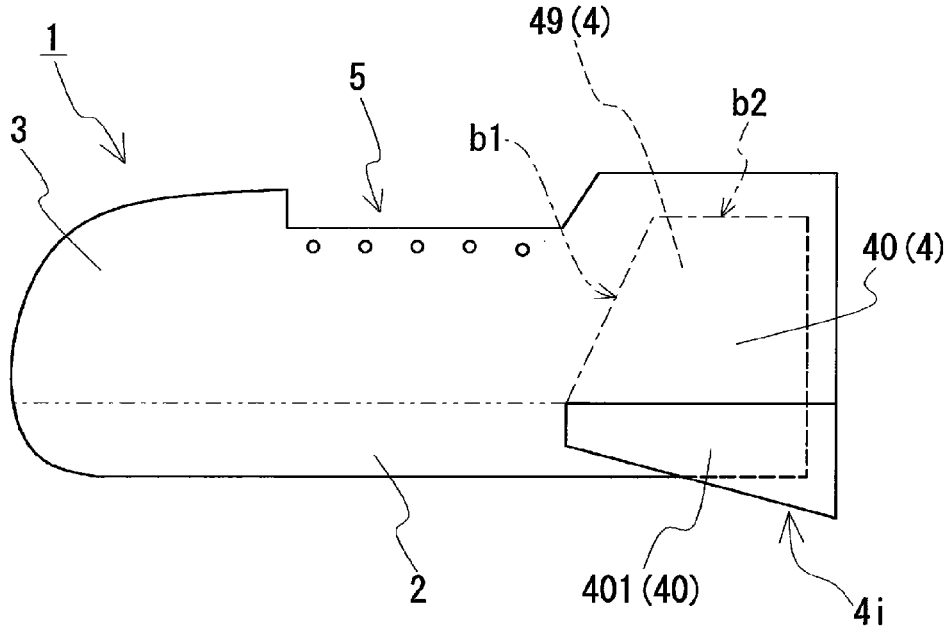
FIG. 6 is a schematic view of a pocket section including a projection shown in a second embodiment.
Figure 6:
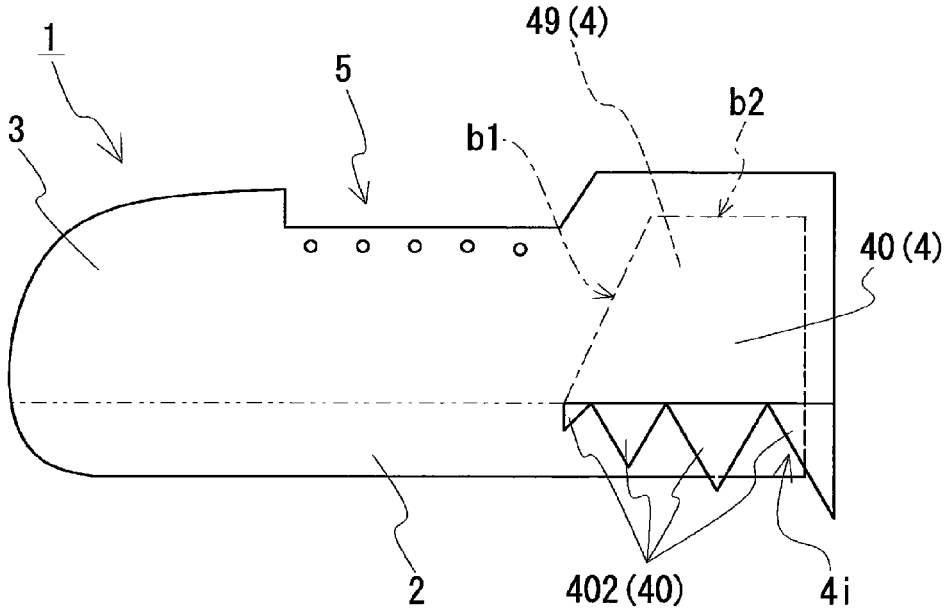

In the first embodiment, the outer side knitted fabric portion 40 configuring the pocket section 4 has a length up to the boundary position of the instep cover section 3 and the sole cover section 2. On the contrary, as shown in FIG. 6, a projection 401 projecting out from the boundary position may be formed in the outer side knitted fabric portion 40. For example, as shown in FIG. 6(A), the projection 401 in which the projection amount on the toe side is small and the projection amount on the heel side is large may be formed on the outer side knitted fabric portion 40. The reinforcement member can be contained inside the pocket section 4 by providing the projection 401, and the pocket opening 4*i* can be reliably closed with the projection 401 by bending the projection 401 toward the toe side. Of course, after the projection 401 is bent toward the toe side, the distal end of the projection 401 may be tucked into the pocket section 4. With the arrangement of such projection 401 on the outer side knitted fabric portion 40, the reinforcement member is less likely to fall out from the pocket section 4 when attaching the outer sole, whereby the task of attaching the outer sole can be facilitated. The wrinkles can be suppressed from forming in the outer side knitted fabric portion 40 when closing the pocket opening 4*i* with the projection 401 by forming a plurality of slits extending in the longitudinal direction in the plane of drawing in the projection 401.

In addition, as shown in FIG. 6(B), a saw-tooth shaped projection 402 may be provided on the outer side knitted fabric portion 40. In this case, the wrinkles can be suppressed from forming in the instep cover section 3 when closing the pocket opening 4*i* of the pocket section with the projection 402. Furthermore, with the saw-tooth shaped projection 402, the knitted fabrics configuring the projection 402 can be avoided from overlapping, so that the wearing comfortableness of the shoe upper 1 is not affected by the overlapping of the knitted fabrics.

DESCRIPTION OF SYMBOLS

1 shoe upper
2 sole cover section
3 instep cover section
4 pocket section
4*i* pocket opening
401, 402 projection
40 outer side knitted fabric portion
40L outer left part
40R outer right part
49 inner side knitted fabric portion
49L inner left part
49R inner right part
5 shoe opening
5*i* foot insertion opening
5*s* slit
60 eyelet hole
b1, b2, b3 joining line

The invention claimed is:

1. A shoe upper comprising:

an instep cover section that covers a portion on an instep side of a wearer;

a sole cover section that covers a sole of the wearer;

wherein the instep cover section and the sole cover section are integrally knitted in a seamless manner;

a pocket section formed extending over a left side portion and a right side portion of the shoe upper and arranged at least at a position of a heel or a toe of the shoe upper;

wherein the pocket section is formed by an outer side knitted fabric portion comprising a part of the instep cover section and an inner side knitted fabric portion overlapping an inner side of the outer side knitted fabric portion and directly connected to the sole cover section; and a pocket opening, which is an opening of the pocket section, that is open at a side of the sole cover section.

2. The shoe upper according to claim 1, wherein the outer side knitted fabric portion includes a projection that projects out toward the sole cover section from a boundary position of the instep cover section and the sole cover section.

3. A method for producing a shoe upper including an instep cover section that covers a portion on an instep side of a wearer and a sole cover section that covers a sole of the wearer; the method comprising:

(a) integrally knitting the instep cover section and the sole cover section in a seamless manner using a flat knitting machine including at least a pair of a front and a back needle bed, and (b) during step (a), knitting a pocket section that extends over a left side portion and a right side portion of the shoe upper and that has an opening at a side of the sole cover section at least at a position of a heel or a toe of the shoe upper; wherein the pocket section is formed by an outer side knitted fabric portion comprising a part of the instep cover section and an inner side knitted fabric portion overlapping an inner side of the outer side knitted fabric portion and directly connected to the sole cover section;

an inner left part, which is a left side portion of the inner side knitted fabric portion, and an outer left part, which is a left side portion of the outer side knitted fabric portion, are knitted while being attached to a needle bed on one side;

an inner right part, which is a right side portion of the inner side knitted fabric portion, and an outer right part, which is a right side portion of the outer side knitted fabric portion, are knitted while being attached to a needle bed on the other side;

the inner left part is temporarily moved to the needle bed on the other side when knitting the outer left part; and the inner right part is temporarily moved to the needle bed on the one side when knitting the outer right part.

4. The method for producing the shoe upper according to claim 3, wherein when knitting the outer side knitted fabric portion, a projection that projects out toward the sole cover section from a boundary position of the instep cover section and the sole cover section is knitted in the outer side knitted fabric portion.

5. The method for producing the shoe upper according to claim 3, wherein knitting is carried out from a shoe opening of the instep cover section toward a central part of the sole cover section or from the central part toward the shoe opening;

when knitting the inner side knitted fabric portion, the inner left part and the inner right part are connected on a side including the pocket section in a knitting width direction; and when knitting the outer side knitted fabric portion, the outer left part and the outer right part are connected on a side including the pocket section in a knitting width direction.

* * * * *